US007942383B2

(12) United States Patent
Tharp

(10) Patent No.: US 7,942,383 B2
(45) Date of Patent: May 17, 2011

(54) AIRPLANE JACK AND METHOD OF USE

(75) Inventor: Derick Tharp, Hawk Point, MO (US)

(73) Assignee: Derick Tharp, Hawk Point, MO (US)

( * ) Notice: Subject to any disclaimer, the term of this patent is extended or adjusted under 35 U.S.C. 154(b) by 0 days.

(21) Appl. No.: 12/454,755

(22) Filed: May 22, 2009

(65) Prior Publication Data

US 2009/0294744 A1 Dec. 3, 2009

Related U.S. Application Data

(60) Provisional application No. 61/128,951, filed on May 27, 2008.

(51) Int. Cl.
*B66D 1/36* (2006.01)

(52) U.S. Cl. ..... 254/280; 254/279; 254/323; 254/325

(58) Field of Classification Search ..... 254/279, 254/280, 323, 324, 325
See application file for complete search history.

(56) References Cited

U.S. PATENT DOCUMENTS 3,028,130 A * 4/1962 Burton ..... 244/137.1
3,797,681 A * 3/1974 Brettrager ..... 414/559
4,113,041 A * 9/1978 Birkeholm ..... 180/14.1
4,135,627 A * 1/1979 McInerney ..... 212/299
5,116,264 A * 5/1992 Wiederrich et al. ..... 108/23
5,232,203 A * 8/1993 Butts ..... 254/8 R
5,536,131 A * 7/1996 Behr ..... 414/495
5,681,139 A * 10/1997 Szanto ..... 414/495
5,697,452 A * 12/1997 Link ..... 172/19
5,975,826 A * 11/1999 Scholder ..... 414/444
5,988,597 A * 11/1999 Egan ..... 254/279
6,065,621 A * 5/2000 Fatemi et al. ..... 212/301
6,123,495 A * 9/2000 Callahan et al. ..... 414/340
6,371,449 B1 * 4/2002 Chamberlain ..... 254/387
6,921,095 B2 * 7/2005 Middleby ..... 280/47.29
7,311,297 B1 * 12/2007 Bradshaw et al. ..... 254/272
2008/0217277 A1 * 9/2008 Spitsbergen ..... 212/179

FOREIGN PATENT DOCUMENTS

GB 2144090 A * 2/1985

* cited by examiner

*Primary Examiner* — Emmanuel M Marcelo

(57) ABSTRACT

A jack for lifting the nose gear on a lightweight aircraft including a wheeled tray adapted to hold weights, a handle for manually moving the jack, and a winch mounted on the jack. The winch including a line adapted to attach to a tie down point on a tail section of the aircraft. Also, a method of using the jack to service the nose gear of alight aircraft including the steps of, loading a weight on a tray, wheeling the tray under a tail section of the aircraft, attaching a line to a tie down point on the airplane opposite the nose gear, and winching the line to apply a downward force on a tail section of the aircraft to lift the nose gear of the airplane off the ground.

8 Claims, 2 Drawing Sheets

AIRPLANE JACK AND METHOD OF USE

CROSS REFERENCES TO RELATED APPLICATIONS

The application claims priority under 35 USC 119e to provisional application 61/128,951 filed May 27, 2008.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to a devices used to service small aircraft.

2. Brief Description of Prior Art

There is a need on occasion to service small aircraft. Small propeller planes often times have a tricycle landing gear, two larger wheels in the middle of the plane and a smaller one under the front nose of the aircraft. When it is required to service the nose landing gear, it is necessary to lift the nose of the aircraft to take weight off the front landing gear. Whereas the middle landing gear has a location to lift the plane using a conventional jack, it is difficult to place a jack under the nose of the aircraft. There is no specific location for jacking and the airframe and skin are easily damaged. Further because the nose of the plane is so light weight placing it on a jack would create an unstable situation where unbalanced forces created in servicing could cause the airplane to fall off the jack. So conventionally pilots, who often service their own small aircraft, will stack sand bags on the tail section of the plane. Enough sand bags will push the tail down and raise the nose and nose landing gear, a few hundred pounds is usually enough. Those familiar with aircraft know that it is generally unadvisable to touch the airframe of an aircraft in a way that it was not designed for. Stacking sand bags on the rear wing of an aircraft is therefore very undesirable and labor intensive, but is common practice.

As will be described, the preferred embodiments of the present invention overcome disadvantages of the prior art.

SUMMARY OF THE INVENTION

A jack and method for use with small light weight aircraft to lift the nose gear of the aircraft is disclosed.

The invention further comprises a jack for lifting the nose gear on a lightweight aircraft including a wheeled tray adapted to hold weights, a handle for manually moving the jack, and a winch mounted on the jack. The winch including a line adapted to attach to a tie down point on a tail section of the aircraft.

The invention still further comprises a method of servicing the nose gear of a light aircraft including the steps of, loading a weight on a tray, wheeling the tray under a tail section of the aircraft, attaching a line to a tie down point on the airplane opposite the nose gear, and winching the line to apply a downward force on a tail section of the aircraft to lift the nose gear of the airplane off the ground

The present invention will be illustrated on the basis of the figures and following description of a preferred embodiment thereof.

DESCRIPTION OF THE PREFERRED EMBODIMENT

Figure 1:
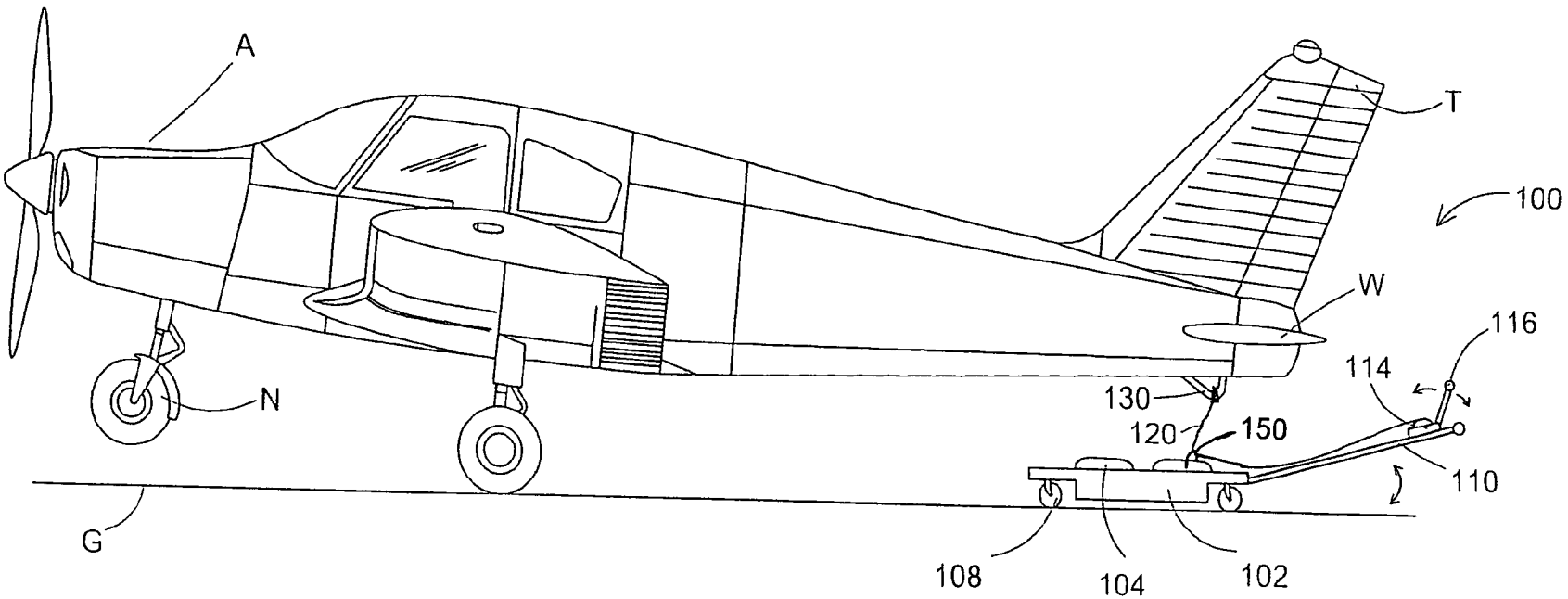
FIG. 1 shows a view of the jack in use.
Figure 2:
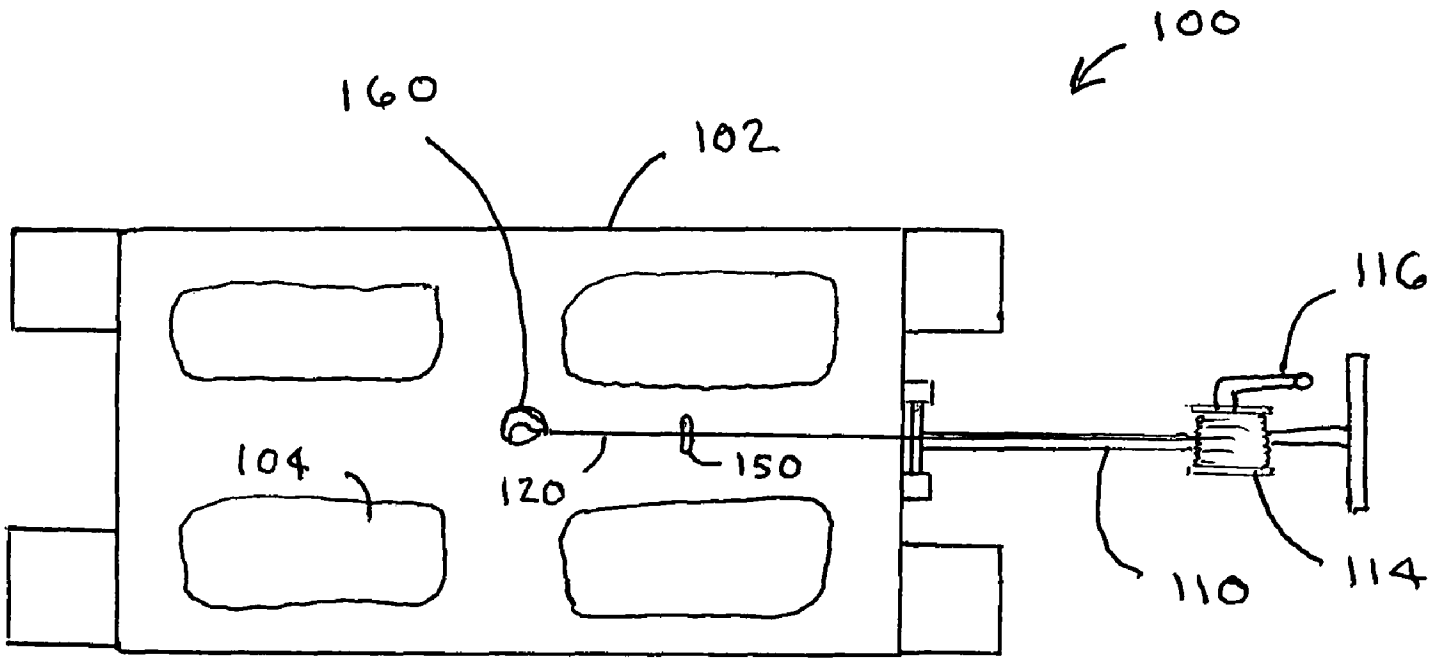
FIG. 2 shows a plan view of the jack.

Referring to FIGS. 1 and 2 and in accordance with the present invention, a jack 100 can be used to lift the front nose gear 'N' of a small light weight aircraft such as a helicopter or airplane 'A'. The jack 100 is unconventional as it works by pulling the tail 'T' down as opposed to directly lifting the front of the airplane 'A'. The jack 100 includes a weighted tray 102 that can carry a plurality of weights such as sand bags 104. A few hundred pounds is typically enough weight. The tray 102 must have enough weight to counter balance the nose of the aircraft so that as the jack 100 pulls down the nose of the aircraft comes off the ground as shown in FIG. 1. Too little weight would cause the jack 100 to come off the ground instead. The tray 102 includes a plurality of wheels such as swivel casters 108. The tray is also connected to a handle such as T Handle 110. The T handle 110 can rotate up and down about its mounting point to the tray 102.

The T handle 110 includes a winch 114 including a rotatable handle 116 and a line 120 that can be attached to the airplane 'A' Most light aircraft have a connection point such as tie down point 130 that is designed to tie the airplane 'A' down to protect it in conditions such as high winds. So the airplane tie down point 130 is designed for that purpose and is strong, the stress created on the tie down when used for jacking is similar to what would be required in tie down and much less than forces that might be created on the tie down during high winds. The tray 102 includes an attachment point such as a loop 150 that attaches the line 120 to the tray but that allows the winch 114 to pull the line 120 through the loop 150. The loop 150 could be of any shape so long as the line 120 can move though the loop 150 while attaching the tie down point 130 to the winch 114 such that winching the line 120 shorter will pull the tail T downward toward the ground G while the nose gear N comes off the ground G.

So in operation several weights such as sand bags 104 are placed in tray 102, or the weights 104 could be built in permanent to the tray 102. Any weight even liquid could be used. An operator then pushes the jack 100 under the tail section of the airplane 'A' and attaches the line 120 to the tie down point 130 on the tail of the airplane 'A', the line can be threaded through loop 150 and attached to the tie down 130 with a quick connect clip 160 for example. By turning winch handle 116, the line 120 is wound onto winch 114 until the line 120 becomes tight and then the nose gear 'N' of the airplane 'A' will come off the ground 'G'. Once the nose gear 'N' is up it can be serviced such as replacing a tire, inspecting, lubricating, cleaning, removing or replacing a bearing for example. Another advantage of the jack 100 is that once the airplane 'A' is in the nose gear lifted position shown in FIG. 1, an operator can move the jack 100 and airplane 'A' by simply pulling or pushing with T handle 110, so the jack 100 also serves as an airplane towing device. This might be desirable for example once the nose gear N was removed it would still be possible to manually move the airplane 'A' in and out of a storage hanger for example.

Although the description above contains many specificities, these should not be construed as limiting the scope of the invention, but as merely providing illustrations of some of the presently preferred embodiments of this invention. It would be obvious to those skilled in the art that modifications made may be made to the embodiments described above without departing from the scope of the present invention. Thus, the scope of the invention should be determined by the appended claims and the formal application and their legal equivalents, rather than by the examples given.

I claim:

1. A jack for lifting the nose gear on a lightweight aircraft including;

wheels, a tray adapted to hold weights, a handle pivotally attached to said jack for manually moving said jack, a winch mounted on said jack, said winch including a line said line passing through a loop on said tray, said line including an attachment point attached to a tie down point on a tail section of an aircraft such that winding the winch will pull the line through the loop and pull the attachment point down toward said loop as aircraft nose gear comes off the ground.

2. The jack of claim 1 including weights in said tray.

3. The jack of claim 1 wherein said winch is attached to the handle of said jack and wherein said winch includes a handle for winding said line onto said winch.

4. A jack for lifting a front portion of an aircraft including;

a weighted tray, a handle pivotally attached to said jack for moving said jack, a winch mounted on said jack, said winch including a line adapted to attach to a tie down point on a tail section of said aircraft such that winding the line on the winch will pull down said tail section of the plane and thus lift said front portion wherein said tray includes a loop that allows the line to moveably attach to the tray such that the line can be wound on said winch and said tie down point can be pulled down toward said tray as said nose gear comes up off the ground.

5. The jack of claim 4 wherein said winch is attached to the handle of said jack and wherein said winch includes a winch handle for winding said line onto said winch.

6. The jack of claim 5 wherein said handle is a T handle.

7. The jack of claim 5 including weights in said tray.

8. The method of servicing the nose gear of a light aircraft including the steps of, loading a weight on a tray, wheeling the tray under a tail section of said aircraft, attaching a line to a tie down point on said airplane opposite said nose gear, winching said line to apply a downward force on a tail section of said aircraft to lift said nose gear of said airplane off the ground.

* * * * *